US008007678B2

(12) United States Patent
Faria et al.

(10) Patent No.: US 8,007,678 B2
(45) Date of Patent: Aug. 30, 2011

(54) TEXTILE YARN SIZING COMPOSITION

(75) Inventors: Milton Faria, Sao Paulo (BR); Charles Cordier, Saint-Etienne (FR)

(73) Assignees: EMZ Trek, Sao Paulo (BR); SNF S.A.S., Saint-Etienne (FR)

( * ) Notice: Subject to any disclaimer, the term of this patent is extended or adjusted under 35 U.S.C. 154(b) by 484 days.

(21) Appl. No.: 11/722,385

(22) PCT Filed: Dec. 16, 2005

(86) PCT No.: PCT/FR2005/051098

§ 371 (c)(1),
(2), (4) Date: Feb. 20, 2009

(87) PCT Pub. No.: WO2006/070147

PCT Pub. Date: Jul. 6, 2006

(65) Prior Publication Data

US 2009/0249596 A1 Oct. 8, 2009

(30) Foreign Application Priority Data

Dec. 22, 2004 (FR) ..... 04 53145

(51) Int. Cl.
*D06M 15/333* (2006.01)

(52) U.S. Cl. ..... 252/8.83; 526/303.1

(58) Field of Classification Search ..... 526/303.1; 252/8.83

See application file for complete search history.

(56) References Cited

U.S. PATENT DOCUMENTS

| | | | |
|---|---|---|---|
| 4,413,087 | A | 11/1983 | Bernot |
| 6,736,865 | B1 | 5/2004 | Danner et al. |

FOREIGN PATENT DOCUMENTS

| | | |
|---|---|---|
| EP | 0066078 | 8/1982 |
| EP | 0262945 | 6/1988 |
| EP | 0659929 | 6/1995 |
| JP | 60258244 | 12/1985 |

OTHER PUBLICATIONS

International Search Report based off International Application No. PCT/FR2005/051098.

*Primary Examiner* — Edward Cain

(74) *Attorney, Agent, or Firm* — Heslin Rothenberg Farley & Mesiti P.C.

(57) ABSTRACT

Temporary sizing agent for natural and/or artificial individualized textile fibers comprises a water-soluble homopolymer or copolymer of at least one acrylamide monomer having a molecular weight not less than one million, advantageously more than three millions.

2 Claims, No Drawings

TEXTILE YARN SIZING COMPOSITION

CROSS-REFERENCE TO RELATED APPLICATIONS

This application is a Section 371 submission of international application PCT/FR2005/051098 filed Dec. 16, 2005, and published, in French, as international publication WO 2006/070147 A2 on Jul. 6, 2007, which claims priority of French application 0453145 filed Dec. 22, 2004, which applications are hereby incorporated herein by reference, in their entirety.

BACKGROUND ART

The present invention relates to a novel composition based on high molecular weight water-soluble acrylamide copolymers for sizing textile yarns (or fibres). The invention applies particularly well to the sizing of natural fibres, particularly of the cotton type, optionally in the presence of artificial fibres, in particular polyester.

In the textile industry, during weaving operations, the yarns or fibres are subjected to repeated stretching. Yarn stretching can cause breakage. The elongation capacity of the yarn. must therefore be exploited, depending on its type.

In addition to the stretching, other stresses exist. These are essentially:

- abrasion: action of wear by friction. This causes hairiness of the yarns, pilling due to friction against various parts (heddles, comb teeth, etc.); and
- hairiness: the tendancy of the fibre ends to separate from the spun yarn body. This can cause interyarn couplings which give rise to yarn breakage or insertion defects by the weft vector.

The use of sizing products is known to protect yarns against these damaging forces and to improve their strength.

To obtain good results, the size must be selected taking account of the following properties:

- break strength and elongation at break,
- flexibility of the size film which must match the elongations undergone by the yarn,
- good adhesion to the yarn,
- appropriate viscosity which depends on the yarns, however, an excessively high viscosity can cause difficulties in case of interruption on the sizing machine.

Moreover, the sizing must not damage the yarn and the liquor must comprise compatible products exclusively. Furthermore, the comb must not be subject to size deposits which, by hardening, could act as abrasives on the yarns.

It should be noted that sizing is an intermediate finish, which is removed after the weaving operation. This operation precedes the finishing of the fabric, after which the size is completely removed. This may prove to be very pollutant because of the releases generated. It is therefore advantageous to have a product which has good solubility for desizing.

Conversely, documents EP-A-262 945 and U.S. Pat. No. 6,736,865 describe products for treating not individualized yarns, but finished woven textiles.

Document EP-A-262 945 thus describes a product combining an acrylamide polymer in the presence of other types of polymers for fastening colour to the previously woven fabric.

Document U.S. Pat. No. 6,736,865 describes a product based on acrylamide in the presence of other components for treating finished textiles to confer crease resistance and dimensional stability, particularly at the time of colour fastening.

In the paper field, document JP 60258244 describes the possibility of making a sheet water-repellent during formation, by treating the paper (and not textile) fibres using a mixture of a cetene and an acrylamide polymer.

The choice of the size mainly depends on the type of chain, and also taking account of the type of weaving:

- dry weaving: rapier, projectile, airjet looms,
- hydraulic weaving: water jet looms which require products unaffected by water in the weaving conditions.

The main types of basic products usable as sizing agents are natural or synthetic polymers, which are classed as follows:

- starches: varieties of starch,
- starch derivatives: ethers, acetates,
- cellulose derivatives: carbOXYmethyl, methyl and ethyl cellulose,
- polyvinyl alcohol and vinyl acetate copolymers, polyesters,
- acrylics; these are mainly suitable for synthetic and artificial yarns;

however, they are also found in combination with starches or cellulose derivatives for natural fibres and mixtures thereof.

Sizing agents of the acrylic type are obtained by homopolYmerization or copolymerization of various derivatives of acrylic acid or methacrylic acid with other monomers such as styrene, vinyl acetate, acrylamide, etc. By an appropriate choice and dosage of the monomers, synthesis produces macromolecular substances, whereof the physical properties can be varied in a very wide interval. This explains the many sizing applications of various yarns: polyamide, polyester, cellulose. The main properties which they provide are:

- excellent interstrand cohesion capacity,
- high performance on dry looms.

However, many constraints apply concerning the use of the abovementioned sizing agents. In particular, they are often associated with the quantities required for these sizes to be effective, and with their low activity when used alone on natural fibres.

The problem faced is therefore to find a novel sizing product for sizing natural and/or artificial fibres on dry looms, and which meets the requirements of the industry, that is:

- good affinity for yarns or fibres,
- easy implementation (sizing speed, etc.),
- improved loom productivity: higher yarn or fibre strength, while limiting comb fouling,
- easy and non-pollutant removal with water, and
- in addition, significantly reduce the quantities of sizing agent and hence the total cost of the operation,

BRIEF SUMMARY OF THE INVENTION

A sizing liquor has now been found for natural and/or artificial textile fibres in the form of an aqueous solution having at least equivalent performance to that of the preexisting compositions, but with significantly lower doses of sizing agent.

A primary subject of the present invention is a temporary sizing agent for natural and/or artificial individualized textile fibres, particularly of the cotton and/or cotton polyester type, characterized in that it comprises a water-soluble homopolymer or copolymer of at least one acrylamide monomer having a molecular weight of at least I million, advantageously above 3 million.

In an advantageous embodiment, the sIzmg agent IS exclusively made of an acrylamide homopolymer or copolymer.

As well known to a person skilled in the art, the larger the quantity of size deposited, the higher the percentage load of the wastewater of the textile plant.

It has been found surprisingly that obtaining an acrylamide based polymer, having a molecular weight above 1 million and having a low ionicity (cationicity and/or anionicity), in practice lower than 10 mol %, preferably lower than 5 mol %, makes it possible, particularly for cotton fabrics and also in the case of mixed polyester/cotton yarns, to obtain considerable savings both in terms of the liquor concentration of the sizing agent and during the de sizing step.

The sizing agent of the invention is obtained in particular by polymerization (or respectively copolymerization, both referred to as "polymerization" throughout the text and the claims) of at least one nonionic monomer of the acrylamide type and optionally other ionic monomers, and advantageously has a UL viscosity above 3.

The polymers of the invention do not require the development of a particular polymerization method. They can be obtained by all polymerization techniques well known to a person skilled in the art (solution polymerization, gel polymerization, precipitation polymerization, emulsion polymerization (aqueous or reverse), followed or not by a spray drying step, suspension polymerization, micellar polymerization, followed or not by a precipitation step).

According to the invention, the water-soluble (co)polymer serving as a sizing agent is obtained from.

- 90 to 100 mol % of acrylamide, preferably 95 to 100 mol %,
- 0 to 10 mol % of at least one monomer having an ionic (anionic and/or cationic) content of preferably 0 to 5 mol %,
- in the presence or absence of at least one branching agent and optionally a transfer agent.

A non-limiting list of ionic monomers suitable for use is given below:

- cationic monomers, of the dialkylaminoalkyl (meth)acrylate, dialkylaminoalkyl (meth)acrylamide, diallylamine, methyldiallylamine type and their quaternary ammonium or acid salts,
- anionic monomers: having a carboxylic function (acrylic acid, methacrylic acid and salts thereof), the monomers having a sulphonic acid function (2-acrylamido-2-methylpropane sulphonic acid (AMPS) and salts thereof, etc.).

A non-limiting list of sizing agents is given below: methylene bisacrylamide (MBA), ethylene glycol di-acrylate, polyethylene glycol dimethacrylate, diacrylamide, cyanomethylacrylate, vinyloxyethylacrylate or methacrylate and formaldehyde, glyoxal, compounds of the glycidylether type such as ethylene glycol diglycidylether, or epoxys or any other means well known to a person skilled in the art and permitting cross-linking.

A non-limiting list of transfer agents is given below: isopropyl alcohol, sodium hypophosphite, mercaptoethanol, etc.

A person skilled in the art will know how to select the best combination according to his own knowledge and the present description, as well as the following examples.

The invention further relates to a sizing liquor comprising the sizing agent as described above at the rate of less than 2% by weight of dry matter, preferably less than 1.5% by weight.

The present invention further relates to a method for sizing/de sizing natural and/or artificial textile fibres, whereby the said fibres are immersed in the liquor described above, and then, after weaving, the fibres are de sized using hot water only.

The concentration of sizing agent in the liquor may vary within the range described above, according to the apparatus employed for the performance of the sizing cycle, particularly the squeezing capacity of the rolls, and the quantity of size to be applied to the yarns. It is known that this depends partly on the strength of the yarns, which itself depends on their texturizing, their degree of twisting, the number of strands per unit yarn, and also on the adhesion of the sizing product to the yarns to be treated.

One of the advantages of the inventive compositions resides in the fact that they provide coatings having good protective power and high adhesive power to the textile yarns of the cotton or polyester/cotton type; accordingly, a concentration equal to 2% by weight or less, preferably less than 1.5%, of the composition is sufficient for all applications, including the most difficult yarns to size.

A deposit representing a larger quantity is perfectly conceivable, but it adds no real advantages and may even be detrimental.

The weft yarns sized in the conditions of the invention have a sufficient strength for subsequent dry weaving operations. The unit strands are correctly bonded and no unravelling or breakage of the yarns, nor fouling of the looms, is observed.

After the weavmg, the desizing stage according to the invention takes place characteristically with hot water. It is completed by drying.

The size compositions according to the invention may be prepared both before their use for sizing and stored, or on contrary, immediately before their use, from their components.

DETAILED DESCRIPTION

The examples below illustrate the invention without limiting it.

EXAMPLES

Data of the Polymers used During the Tests as Sizing Agent

| Sizing Agent | Type | Composition | Ionocity | Molecular Weight | UL Viscosity |
|---|---|---|---|---|---|
| P1 | (gel polym.) powder | AM | 0 mol % anionic | 8 million | 4 |
| P2 | (gel polym.) powder | Hydrolyzed AM | 5 mol % anionic | 5 million | 4.4 |
| P3 | (gel polym.) powder | AM/ADC | 5 mol % anionic | 6 million | 3.6 |

AM: acrylamide

ADC: dimethyl amino ethyl acrylate quaternised by methyl chloride

The UL viscosity is measured using the Brookfield viscometer (UL type module) at a speed of 60 rpm and at a temperature of 25° C. on a salt solution (1 M NaCl) of polymer containing 0.1% concentration (dry weight).

Data on the Sizing Tests Performed

After having placed the polymer in solution in the water at the desired concentration, the solution is then stirred for a few minutes, the composition is then ready for use to prepare a sizing liquor.

Various chains of yarns are immersed in this liquor, and then drained by passage between two cylinders followed by drying.

The table below gives the test conditions:

| Yarn | Mass Length (expressed in British numbers (Ne) | Machine | Type | Polymer Viscosity Cuts (Zahn 3) | Size Volume % Polymer (dry matter) |
|---|---|---|---|---|---|
| 100% Cotton | 20/1 | Tsudakoma 4350 yarns | Airjet 750 rpm | PI 8 s | 500 1 0.8% |
| 100% Cotton | 30/1 | Tsudakoma 4350 yarns | Airjet 750 rpm | P2 8 s | 500 1 1% |
| Cotton/polyester 50/50 | 24/1 | Picanol 5484 yarns | Airjet 750 rpm | P2 8 s | 500 1 1.2% |
| Cotton/polyester 33/67 | 16/1 | Nissan 5700 yarns | Airjet 750 rpm | P3 8 s | 450 1 1.2% |

Results

The weaving carried out using the yarns described above takes place in satisfactory conditions without unravelling or strand breakage. After weaving, the fabric is treated wide and unwound into a hot water bath at 50° C. and then dried (desizing operation).

Immediately after this treatment, the fabrics are conventionally dyed. The finished, dried fabric was very flexible; it also revealed excellent colour uniformity and good resistance to washing and light.

Comparatively, a sizing was carried out in strictly identical conditions to the above, but using sizing products currently available on the market of the types—sodium acrylate homopolymer (MW: 800 000 and 350 000) and acrylamide homopolymer (MW: 800 000 and 350 000).

It was found that to obtain equivalent sizing quality as obtained with the polymers of the invention (no unravelling nor yarn breakage) on the same natural or mixed fibres, it was necessary to use these polymers in very high concentrations:

systematically above 5%, when used alone, and above 3%, when other agents, conventionally used, such as polyvinyl alcohol, urea and/or lubricant are present in the liquor.

Conclusion

According to the present invention, it has been discovered surprisingly that the high molecular weights of the water-soluble acrylamide (co)polymers of the invention confer on the sizing liquor:

a clear improvement in the conditions of use: easy preparation and de sizing and also lower liquor kinematic viscosity (viscosity cuts), and highly developed sizing efficiency, accordingly significantly limiting the concentration of application of the liquor compared to the concentration necessary for products of the same chemical type and lower molecular weight.

We claim:

1. Method for sizing/desizing natural and/or artificial textile fibres, wherein the fibres are immersed in a sizing liquor, and then, after weaving, the fibres are de sized using hot water only, wherein said sizing liquor contains less than 2% by weight of dry matter of a sizing agent, said sizing agent comprising a water-soluble homopolymer or copolymer of at least one acrylamide monomer having a molecular weight of at least 1 million.

2. Sizing/desizing method according to claim 1, wherein the fibres are cotton fibres or a mixture of cotton and polyester fibres.

* * * * *